US006508467B1

(12) United States Patent
Guindon

(10) Patent No.: US 6,508,467 B1
(45) Date of Patent: Jan. 21, 2003

(54) SWAP THE BIRDS PUZZLE

(76) Inventor: Edward J. Guindon, 1317 Panorama Cir., Birmingham, AL (US) 35216

( * ) Notice: Subject to any disclaimer, the term of this patent is extended or adjusted under 35 U.S.C. 154(b) by 0 days.

(21) Appl. No.: 09/953,607

(22) Filed: Sep. 17, 2001

(51) Int. Cl.[7] ..... A63F 9/08
(52) U.S. Cl. ..... 273/153 S; 273/156
(58) Field of Search ..... 273/153 S, 155, 273/156

(56) References Cited

U.S. PATENT DOCUMENTS 636,109 A * 10/1899 Bowers ..... 273/153 S
3,637,215 A 1/1972 Keister ..... 273/155
3,655,194 A 4/1972 Pierson ..... 273/153 S
4,451,040 A * 5/1984 Ashley ..... 273/153 S
4,735,417 A * 4/1988 Gould ..... 273/153 S
5,135,225 A 8/1992 Pszotka et al. ..... 273/153 S
5,411,261 A * 5/1995 Jacques ..... 273/156

FOREIGN PATENT DOCUMENTS

SU 1440517 A1 * 11/1988 ..... 273/153 S

* cited by examiner

*Primary Examiner*—Steven Wong
(74) *Attorney, Agent, or Firm*—Wm. Randall May

(57) ABSTRACT

A three dimensional puzzle is disclosed wherein the puzzle player is required to rotate or manipulate interlocking disc members along a puzzle base so as to orient notched areas along the perimeter of a number of the discs in order to remove and then reinsert asymmetrical "bird-like" play pieces being held in recesses or repositories within the puzzle base.

12 Claims, 2 Drawing Sheets

SWAP THE BIRDS PUZZLE

BACKGROUND OF THE INVENTION

This invention relates generally to puzzle toys and more specifically to a three-dimensional puzzle wherein an array of rotatable discs are arranged in an overlapping and rotatably interlocking fashion along a base member with some of the discs being notched so that when the discs have been properly aligned or arranged, the notches on the discs form a passageway or portal through which generally X-shaped forms or "birds" may be removed from, or received by, the base member. The design and construction of the present invention requires a player to work through the puzzle twice in order to "swap the birds" and thereby solve the puzzle. The invention provides entertainment for both adults and children and requires the use of motor skills and spatial relationship recognition skills to successfully solve the puzzle. The puzzle has features which provide a moderate challenge to most adults and will, of course, provide a more difficult challenge to children still developing their motor and spatial relationship recognition skills.

Three dimensional prior art puzzles utilizing rotatable discs or disc-like objects are not new. However, the object or goal of most prior art puzzles that utilize rotatable discs is to use the discs to move various puzzle pieces, generally flat parabolic-shaped objects, around or through a puzzle board. Another prior art device allows the discs themselves be manipulated and moved with respect to each other along a track or slot, the object or goal of the puzzle being to unlock and laterally remove or disengage the discs from the puzzle base. The puzzle pieces designed for these prior art devices also generally tend to be identical or substantially similar thereby requiring little, if any, spatial relationship recognition skills in order to solve the puzzle. Examples of these prior art devices can be found in the disclosures contained in U.S. Pat. No. 5,135,225 to Pszotka, et al., U.S. Pat. No. 3,637,215 to Keister and U.S. Pat. No. 3,655,194 to Pierson. The goal or object of the present invention is to solve the puzzle by sequentially rotating or manipulating interlocking disc members so as to orient notched areas along the circumference of a number of the discs in order to remove and thereafter swap play pieces being held in a recess or repository within the puzzle base member.

SUMMARY OF THE INVENTION

Accordingly, in view of the foregoing, it is a primary object of this invention to provide a new, entertaining and challenging puzzle apparatus requiring the player to utilize both motor and spatial relationship recognition skills in order to work through and effectively solve the puzzle.

According to an embodiment of the invention, a three-dimensional puzzle apparatus comprises a support or base member having an array of ten or more rotatable discs. The support or base member also has two or more recessed or countersunk repositories shaped for receiving removable, generally X-shaped, forms or "birds". The "birds" are situated along the base member beneath the rotatable discs and have removal pegs attached thereto in order to facilitate the removal or replacement of the "birds" during the puzzle solving process. Each of the rotatable discs have one or more concave sections removed from its perimeter and the discs are positioned along one side of the support or base member in such a manner that, were it not for the removal of the concave sections, the discs would tend to radially overlap each other. The discs are designed to "mate" or rotatably interlock in such a fashion that no more than two of the discs are allowed to rotate at any given time. In addition to the concave sections, eight of the discs (two sets of four contiguous discs) also have a notched area along each disc's perimeter. When each set of four discs are properly arranged through a series of rotations or manipulations, the notched areas along the perimeter of the discs align to create a portal or passageway in the shape of the X-shaped form at the location of each of the recessed or countersunk repositories of the support member. In accordance with the inventor's design, it is not possible for both sets of notched discs to be rotated or manipulated so as to expose more than one X-shaped form at any one time. The removable X-shaped forms are slightly asymmetrical with respect to each other and are received into the repositories of the base member as mirror images of each other. The puzzle is solved by the manipulation or rotation of the discs so as to allow the removal of the X-shaped forms from the support member, one by one. Each form must then be rotated or flipped and returned to an accommodating repository in order to complete the puzzle. Because the forms are slightly asymmetrical with respect to each other, and because the repositories are mirror images of each other, the forms must not only be rotated or flipped, but must also be swapped in order to be reinserted or placed back into the repositories of the base member and thereby successfully complete the puzzle.

It is an overall objective of the present invention to provide an enticing, compelling and entertaining game which can be played by adults and children alike and which provides varying degrees of challenge depending on the player's motor and spatial relationship recognition skills.

Another objective of the present invention is to provide an excellent means of passing time for both children and adults while providing a tool for learning, developing and practicing desirable skills.

It is an object of the present invention to provide a three dimensional rotating disc puzzle wherein the puzzle solver is required to recognize certain constraints in moving or manipulating contiguous discs and to recognize the series of steps necessary to remove those constraints and thereby successfully solve the puzzle.

It is an object of the present invention to provide a three dimensional rotating disc puzzle wherein the disc arrangement requires the puzzle solver to work through a sequence of moves twice in order to solve the puzzle.

It is a further object of the present invention to provide a three dimensional rotating disc puzzle wherein the solver must be able to visualize certain moves before being able to execute them.

It is a further object of the present invention to require the puzzle solver to look forward and to work backwards in order to identify the proper arrangement of the discs and the sequence of moves necessary to achieve the proper arrangement and thereby solve the puzzle.

An advantage of the present invention is the provision of an instructive, challenging and entertaining game which is very simple and economical to construct.

Another advantage of the present invention is that the game is intriguing, yet simple, thereby creating a tendency in players to want to play the game over and over thereby occupying and entertaining the player for extended periods of time.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
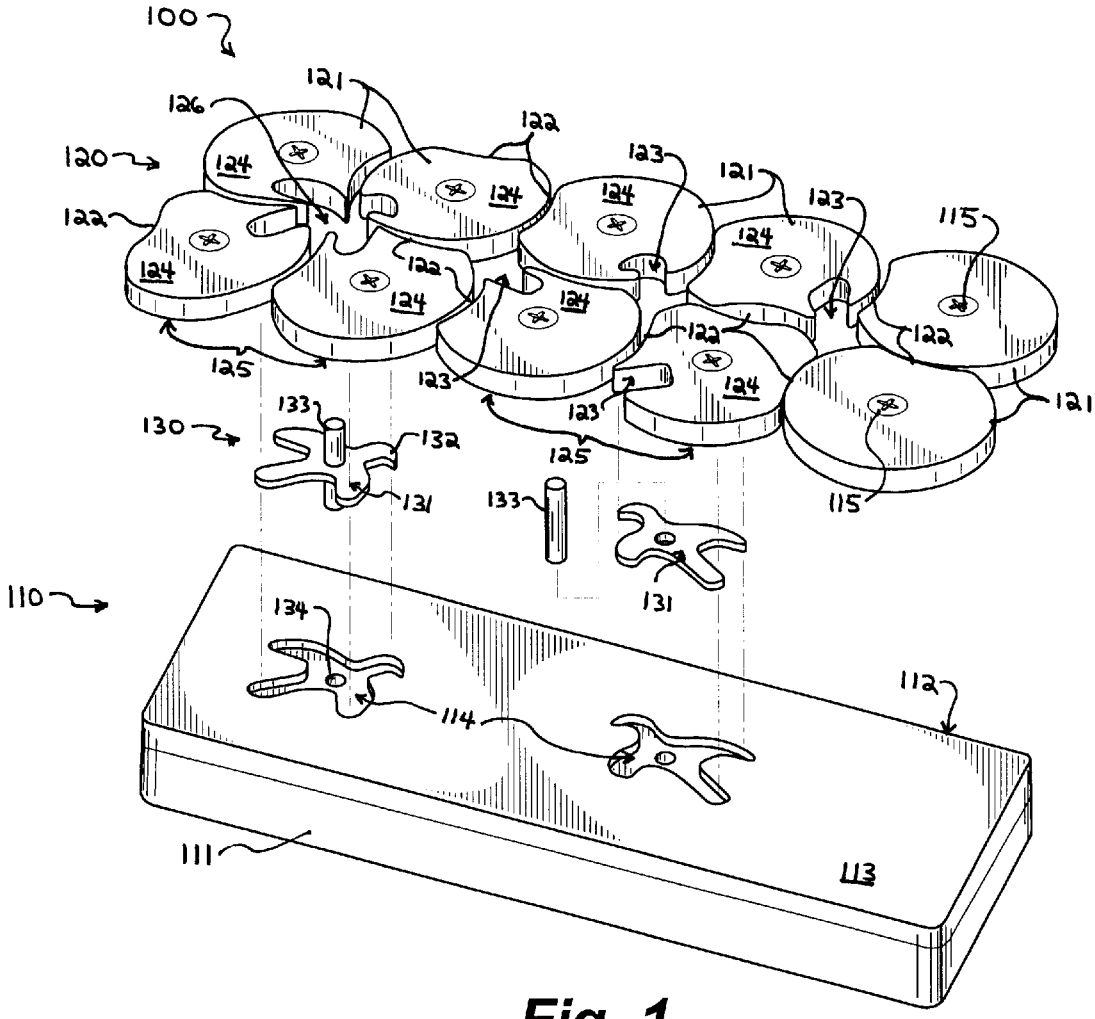
FIG. 1 is an exploded perspective elevational view of an embodiment of the invention showing the relative positioning of the various puzzle play pieces and the accompanying design of the support base.
Figure 2:
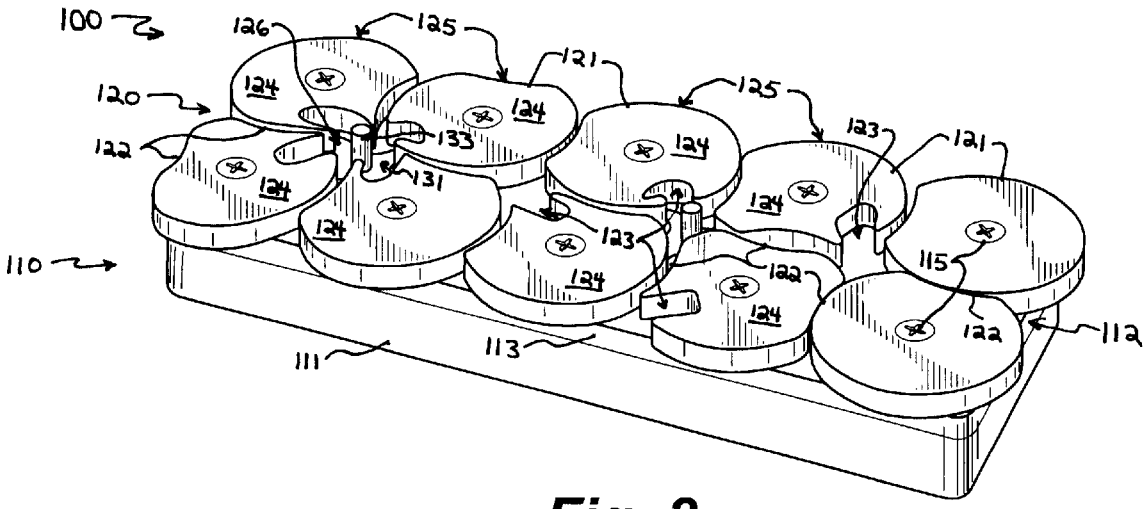
FIG. 2 is a perspective elevational view of the embodiment of FIG. 1 showing the invention in a state of play.
Figure 3:
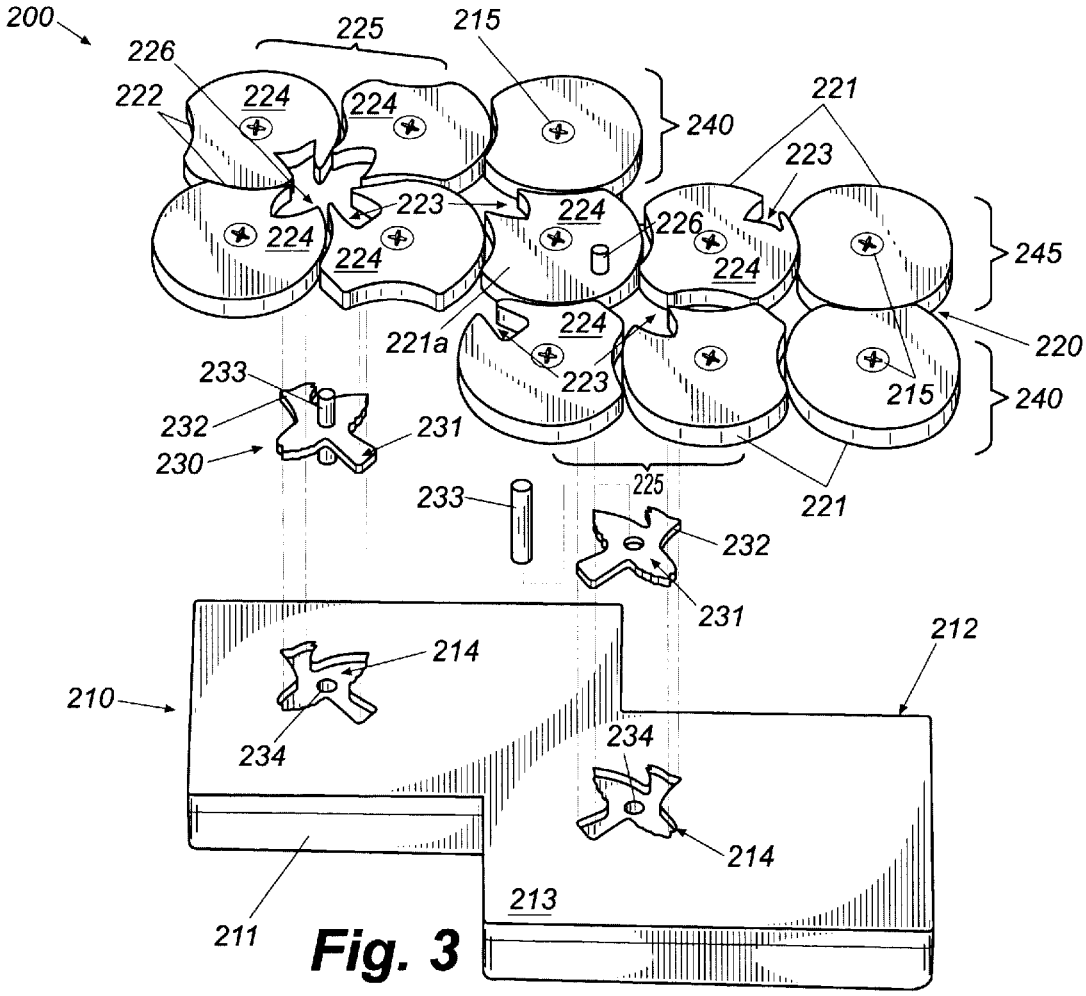
FIG. 3 is an exploded perspective elevational view of an alternate embodiment of invention showing the relative positioning of the various puzzle play pieces and the accompanying design of the support base.
Figure 4:
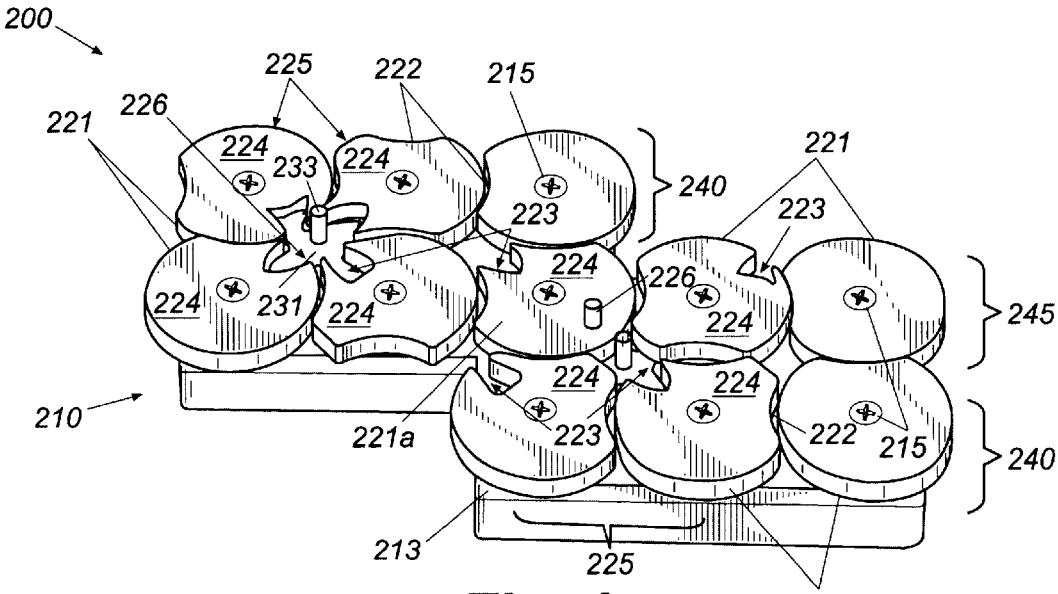
FIG. 4 is a perspective elevational view of the embodiment of FIG. 3 showing the invention in a state of play.

In accordance with an embodiment of the invention FIGS. 1 and 2, show a "swap the birds" puzzle apparatus 100 comprising a base member 110, an array of rotatable discs 120 and play pieces 130. FIGS. 3 and 4 show an alternate embodiment 200 of the invention displaying one of many possible configurations or variations of the puzzle apparatus 100 of FIGS. 1 & 2.

The base member 110 of FIG. 1 comprises a three-dimensional rectangular-shaped support means 111 and a similarly shaped repository means 112. The support means 111 may be constructed of any rigid material, however, for ease of construction and for cost considerations, a light-weight and easily shaped material such as wood or plastic should be used. The repository means 112 is securely attached to the upper surface of the support means 111 and comprises a layer 113 of rigid material similar to that of the support means 111. As can be best seen in FIG. 2, said layer 113 of said repository means 112 has been machined so as to remove portions within the interior of the layer 113 thereby creating a pair of repository templates 114 in the shape of the play pieces 130. The repository templates 114 of said repository means 112 are of sufficient size so as to allow said play pieces 130 to easily and slidably engage the templates 114. The layer 113 of said repository means 112 is of sufficient depth so as to allow said play pieces 130 to be received into said templates 114 with the upper surface of said play pieces 130 being flush or slightly recessed with respect to the upper surface of said repository means 112.

In the embodiment of FIGS. 1 & 2, the array of rotatable discs 120 comprises a total often discs 121 arranged in two rows of five discs 121 each. All discs 121 are rotatably attached to the upper surface of the repository means 112 through the use of axle means 115 such as screws or pins attached through the center of each disc 121. Each disc 121 has one or more concave sections 122 removed from its perimeter with the location and number of said concave sections 122 for each disc 121 being dependent on the position of the disc 121 in relation to other contiguous discs 121 in the disc array 120. The positioning of the discs 121 along said repository means 112 is such that, were it not for the removal of the concave sections 122 from the perimeter of the discs 121, the discs 121 would tend to radially overlap each other. As best seen in FIG. 2, each disc 121 adjoins either two or three other discs 121 and can be rotated only when the adjoining discs 121 have been properly arranged. The removal of the concave sections 122 of the discs 121 and the relative positioning of the discs 121 with respect to each other, and with respect to said concave sections 122, allows the discs 121 to cooperatively "mate" or rotatably interlock with other contiguous discs within the array 120 in such a manner as to allow no more than two of the discs 121 to be manipulated or rotated at any given time.

In addition to the removal of the concave sections 122, eight of the discs 121, referred to hereinafter as "capturing" discs 124, also have a notched area 123 along the perimeter of each capturing disc 124. The rotatable discs 121 having these notched areas 123 are grouped into two sets 125 of four discs each with the capturing discs 124 of each set 125 being rotatably contiguous to one another. The notched areas 123 of the capturing discs 124 of each set of discs 125, when properly arranged through a series of rotations and/or manipulations, align to create a portal or passageway 126 in the shape of the play pieces 130 at the location of the templates 114 of said repository means 112. Alignment of the capturing discs 124 in this manner, and the creation of the resulting portals 126, allows the play pieces 130 of the puzzle 100 to be removed from, or inserted into, the repository templates 114 of the repository means 112 as necessary in order to play, and ultimately solve, the puzzle 100. In accordance with the inventor's design, it is not possible for both sets 125 of capturing discs 124 to be rotated or manipulated so as to expose, remove or insert more than one play piece 130 at any given time.

The play pieces 130 of the present invention comprise generally "X" shaped forms 131 which have been designed by the inventor to resemble the shape of birds in flight. The X-shaped forms 131, or "birds", are slightly asymmetrical with respect to each other and are received into the templates 114 of the repository means 112, and through the portals 126 formed by the two sets 125 of capturing discs 124, as mirror images of each other. In the present embodiment of the invention, the asymmnetical shape of the birds 131 with respect to each other is accomplished by having the head 132 of each bird 131 turned in an opposing direction when the birds 131 are positioned within the templates 114 of the repository means 112. Positioning pegs 133 are centrally attached at either side of each bird 131 to assist in the removal and insertion of the birds 131 during puzzle play. Centering holes 134 are drilled into the support means 111 of the base member 110 at the location of each repository template 114 for receiving the positioning pegs 133 of the birds 131 when the birds 131 are at rest within said templates 114.

The initial pre-play configuration of the puzzle 100 has both birds 131 inserted into their respective repository templates 114 within the support base 111 and the array of discs 120 being rotated so that neither bird 131 is exposed by the notched areas 123 of the capturing discs 124 and therefore cannot be readily removed from the puzzle support base 111. The puzzle 100 is solved by the manipulation and/or rotation of the discs 121 of the disc array 120 so as to cause the notched areas 123 of the capturing discs 124 of each capturing disc set 125 to align to form the portals 126 through which the birds 131 may be removed from the repository means 112 of the support base 111, one bird 131 at a time. Each bird 131 must then be rotated or flipped and returned to an accommodating repository template 114 in order to successfully complete the puzzle 100. Because the birds 131 are slightly asymmetrical with respect to each other, and because their accompanying templates 114 and portals 126 are mirror images of each other, the birds 131 must not only be rotated or flipped, but the birds 131 must also be "swapped" in order to be reinserted or placed back into the repository templates 114 of the repository means 112 of the puzzle 100.

In the alternate embodiment of FIGS. 3 & 4, a "swap the birds" puzzle apparatus 200 comprises a base member 210, an array of rotatable discs 220 and play pieces 230. With the exception of the shape of the base member 210 and the number, location and sequencing of the array of rotatable discs 220, the alternate embodiment 200 of the present invention is substantially similar to the embodiment 100 of FIGS. 1 & 2 in form, object and play.

As with the previous embodiment, the base member 210 of FIG. 3 comprises a support means 211 and a repository means 212. The shape of the base member 210 of the present embodiment is that of an irregular three-dimensional polygon formed by the intersection of two rectangular-shaped blocks. As with the embodiment of FIGS. 1 & 2, the repository means 212 is securely attached to the upper surface of the support means 211 and comprises a layer 213 of rigid material similar to that of the support means 211. As can be best seen in FIG. 3, said layer 213 has been machined so as to create a pair of repository templates 214, within the interior of the layer 213, in the shape of the play pieces 230. The repository templates 214 of said repository means 212 are of sufficient size so as to allow said play pieces 230 to easily and slidably engage the templates 214. The layer 213 of said repository means 212 is of sufficient depth so as to allow said play pieces 230 to be received into said templates 214 with the upper surface of said play pieces 230 being flush or slightly recessed with respect to the upper surface of said repository means 212.

In the embodiment of FIGS. 3 & 4, the array of rotatable discs 220 comprises a total of eleven discs 221 arranged in two rows 240 of three discs each and one row 245 of five discs. All discs 221 of said array 220 are rotatably attached to the upper surface of the repository means 212 through the use of axle means 215 such as screws or pins attached through the center of each disc 221. The five-disc row 245 contains a central disc 221A which is contiguous with members of both three-disc rows 240 as shown and is the only disc 221A of said array 220 which is contiguous with members of both three-disc rows 240. Each disc 221 of said array 220, including the central disc 221A, has one or more concave sections 222 removed from its perimeter with the location and number of said concave sections 222 for each disc 221 being dependent on the position of the disc 221 in relation to other contiguous discs in the disc array 220. The positioning of the discs 221 of said array 220 along said repository means 212 is such that, were it not for the removal of the concave sections 222 from the perimeter of the discs 221, the discs 221 would tend to radially overlap each other. As best seen in FIG. 3, with the exception of the central disc 221A of the five-disc row 245, each disc 221 of said array 220 adjoins either two or three other discs 221 from said array 220 and can be rotated only when the adjoining discs 221 have been properly arranged. The central disc 221A is adjoined by four other discs 221 from said array 220, one from each three-disc row 240 and two from the five-disc row 245. The removal of the concave sections 222 of the discs of said array 220 and the relative positioning of the discs 221 with respect to each other, and with respect to said concave sections 222, allows the discs 221 to cooperatively "mate" or rotatably interlock with other contiguous discs 221 within the array 220 in such a manner as to allow no more than two of the discs 221 to be manipulated or rotated at any given time.

In addition to the removal of the concave sections 222, eight of the discs 221, referred to hereinafter as "capturing" discs 224, also have a notched area 223 along the perimeter of each capturing disc 224. The rotatable discs of said array 220 having these notched areas 223 are grouped into two sets 225 of four discs each with the capturing discs 224 of each set 225 being rotatably contiguous to one another. One set 225 of capturing discs 224 includes the central disc 221A. Because the central disc 221A is "disc locked" with contiguous discs 221 situated on every side of the disc 221A, the central disc 221A is provided with a rotation peg 226 on its upper surface near its perimeter so as to allow a player to easily manipulate or rotate the central disc 221A as necessary during puzzle play. The notched areas 223 of the capturing discs 224 of each set of discs 225, when properly arranged through a series of rotations and/or manipulations, align to create a portal or passageway 226 in the shape of the play pieces 230 at the location of the templates 214 of said repository means 212. Alignment of the capturing discs 224 in this manner, and the creation of the resulting portals 226, allows the play pieces 230 of the puzzle 200 to be removed from, or inserted into, the repository templates 214 of the repository means 212 as necessary in order to play, and ultimately solve, the puzzle 200. In accordance with the inventor's design, it is not possible for both sets 225 of capturing discs 224 to be rotated or manipulated so as to expose, remove or insert more than one play piece 230 at any given time.

As with the previous embodiment, the play pieces 230 of the present embodiment comprise generally "X" shaped forms 231 which have been designed by the inventor to resemble the shape of birds in flight. The X-shaped forms 231, or "birds", are slightly asymmetrical with respect to each other and are received into the templates 214 of the repository means 212, and through the portals 226 formed by the two sets 225 of capturing discs 224, as mirror images of each other. In this embodiment of the invention, the asymmetrical shape of the birds 231 with respect to each other is accomplished by having the head 232 of each bird 231 turned in an opposing direction when the birds 231 are positioned within the templates 214 of the repository means 212. Positioning pegs 233 are centrally attached at either side of each bird 231 to assist in the removal and insertion of the birds 231 during puzzle play. Centering holes 234 are drilled into the support means 211 of the base member 210 at the location of each repository template 214 for receiving the positioning pegs 233 of the birds 231 when the birds 231 are at rest within said templates 214.

As with the previous embodiment, the initial pre-play configuration of the puzzle 200 has both birds 231 inserted into their respective repository templates 214 within the support base 211 and the array of discs 220 being rotated so that neither bird 231 is exposed by the notched areas 223 of the capturing discs 224 and therefore cannot be readily removed from the puzzle support base 211. As with the previous embodiment, the puzzle 200 is solved by the manipulation and/or rotation of the discs 221 of the disc array 220 so as to cause the notched areas 223 of the capturing discs 224 of each capturing disc set 225 to align to form the portals 226 through which the birds 231 may be removed from the repository means 212 of the support base 211, one bird 231 at a time. As with the previous embodiment, each bird 231 must then be rotated or flipped and returned to an accommodating repository template 214 in order to successfully complete the puzzle 200. Because the birds 231 are slightly asymmetrical with respect to each other, and because their accompanying templates 214 and portals 226 are mirror images of each other, the birds 231 must not only be rotated or flipped, but the birds 231 must also be "swapped" in order to be reinserted or placed back into the repository templates 214 of the repository means 212 of the puzzle 200

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. A three-dimensional rotating disc puzzle apparatus comprising:

a base member having two or more recessed areas along the surface of one side of said base member;

an array of cooperatively interlocking disc members rotatably attached along the surface of the side of said base member containing said recessed areas, said disc members having one or more concave sections removed from the perimeter of said discs so as to allow said array of discs to be positioned on said base member in a cooperatively interlocking manner with respect to each other, said positioning allowing the manipulation or rotation of no more than two discs at any given time, a plurality of said disc members having notched areas along the perimeter of said discs so that when said notched discs are properly arranged through a series of rotations or manipulations, the notched areas of said discs align to create a portal or passageway in the shape of, and in direct alignment with, said recessed area of said base member; and, two or more play pieces in the shape of the recessed areas of said base member, each play piece being removably received by one of said recessed areas of said base member, the insertion or removal of said play pieces to and from the recessed areas of said base member being allowed only when the notched areas of said discs are aligned so as to create said portal or passageway.

2. The apparatus of claim 1, wherein said array of interlocking disc members comprises a plurality of discs arranged in two linear rows with an equal number of discs in each row.

3. The apparatus of claim 1, wherein said array of interlocking disc members comprises a plurality of discs arranged in three or more linear rows with at least one row of discs having an unequal number of discs in said row in relation to the number of discs in the remaining rows.

4. The apparatus of claim 1, wherein each disc of said array adjoins either two or three other discs depending on the disc's position within said array and can be rotated or manipulated only when the adjoining discs have been properly arranged.

5. The apparatus of claim 1, wherein at least one disc of said array adjoins four other discs within said array and wherein said disc can be rotated or manipulated only when the adjoining discs have been properly arranged.

6. The apparatus of claim 2, wherein the number of discs comprising said array is at least ten.

7. The apparatus of claim 3, wherein the number of discs comprising said array is at least eleven.

8. The apparatus of claim 1, wherein said recessed areas are of sufficient depth so as to allow said play pieces to be received into said recessed areas with the upper surface of said play pieces being flush or slightly recessed with respect to the upper surface of said base member.

9. The apparatus of claim 1, wherein said recessed areas of said base member comprise generally X-shaped repositories for receiving said play pieces and wherein the shape of at least one of said repositories is the mirror image of the other repositories.

10. The apparatus of claim 1, wherein said play pieces comprise generally X-shaped forms wherein said forms are slightly asymmetrical with respect to each other when positioned within said recessed areas of said base member.

11. The apparatus of claim 1, wherein said plurality of notched discs comprise two or more sets of four rotatably contiguous discs with said discs being cooperatively interlocked in a manner which allows only one set of such discs, at any given time during puzzle play, to be rotated or manipulated so as to create said portal or passageway.

12. The puzzle apparatus of claim 1, wherein the shape and positioning of said array of discs on said base member and the shape and position of said play pieces within said recessed areas of said base member requires the puzzle player to work through a series of disc rotations and/or manipulations twice in order to successfully solve the puzzle.

* * * * *